US008715041B2

(12) United States Patent
Wu

(10) Patent No.: US 8,715,041 B2
(45) Date of Patent: May 6, 2014

(54) ATTACHMENT TYPE SHARPENING TOOL

(75) Inventor: Shih-Piao Wu, Changhua Hsien (TW)

(73) Assignee: Jiin Haur Industrial Co. Ltd., Changhua (TW)

( * ) Notice: Subject to any disclaimer, the term of this patent is extended or adjusted under 35 U.S.C. 154(b) by 155 days.

(21) Appl. No.: 13/409,237

(22) Filed: Mar. 1, 2012

(65) Prior Publication Data

US 2013/0231033 A1 Sep. 5, 2013

(51) Int. Cl.
*B24D 15/08* (2006.01)

(52) U.S. Cl.
USPC ..... 451/552; 451/349; 451/461; 451/555

(58) Field of Classification Search
USPC ..... 451/45, 349, 461, 552, 553, 555, 556, 451/557, 558; 76/88
See application file for complete search history.

(56) References Cited

U.S. PATENT DOCUMENTS

| | | | | |
|---|---|---|---|---|
| 5,046,385 | A * | 9/1991 | Cozzini et al. | 76/89.2 |
| 5,643,059 | A * | 7/1997 | Chen | 451/164 |
| 6,782,576 | B1 * | 8/2004 | Valencic et al. | 7/158 |
| 7,066,796 | B2 * | 6/2006 | Pfaus | 451/344 |
| 7,108,595 | B2 * | 9/2006 | Reisinger | 451/461 |
| 7,153,200 | B1 * | 12/2006 | Wu | 451/344 |
| 7,172,500 | B1 * | 2/2007 | Wu | 451/319 |
| D541,615 | S * | 5/2007 | Wu | D8/93 |
| 7,374,470 | B2 * | 5/2008 | Fuchs | 451/5 |
| 7,381,120 | B2 * | 6/2008 | Henry | 451/439 |
| D618,532 | S * | 6/2010 | Wu | D8/71 |
| 8,221,199 | B2 * | 7/2012 | Smith | 451/552 |
| 8,267,749 | B2 * | 9/2012 | Smith et al. | 451/349 |
| 8,485,867 | B2 * | 7/2013 | Wu | 451/349 |
| 8,512,105 | B2 * | 8/2013 | Smith | 451/461 |
| 2009/0275272 | A1 * | 11/2009 | Bonapace | 451/321 |
| 2009/0325473 | A1 * | 12/2009 | Smith et al. | 451/555 |
| 2011/0136412 | A1 * | 6/2011 | Dovel | 451/45 |
| 2011/0201257 | A1 * | 8/2011 | Walker | 451/45 |
| 2012/0270481 | A1 * | 10/2012 | Smith | 451/461 |

* cited by examiner

*Primary Examiner* — Eileen P. Morgan
(74) *Attorney, Agent, or Firm* — Che-Yang Chen; Law Office of Michael Chen

(57) ABSTRACT

A sharpening tool includes a main base (10) having a mounting seat (12) provided with a first receiving recess (121) and a second receiving recess (122), two first grinding blades (13) mounted in the first receiving recess, an attachment device (11) mounted on the main base, a grinding unit (20) mounted on the mounting seat, and a cover (30) mounted on the mounting seat. The grinding unit includes a second grinding blade (21) mounted in the second receiving recess and having a grinding face (211), and a catch plate (23) mounted on the second receiving recess and having an abutting portion (231) facing the grinding face of the second grinding blade. The first grinding blades provide a double-side grinding function, and the second grinding blade provides a one-side grinding function.

5 Claims, 6 Drawing Sheets

ATTACHMENT TYPE SHARPENING TOOL

BACKGROUND OF THE INVENTION

1. Field of the Invention

The present invention relates to a hand tool, and more particularly to an attachment type sharpening tool for grinding a blade of a cutting tool, such as a knife, a pair of scissors, a pair of shears or the like.

2. Description of the Related Art

A conventional grindstone is used to grind the blade of a cutting tool (such as a knife, a pair of scissors, a pair of shears or the like) when the blade is blunted or rusted. However, the user has to hold the grindstone by his one hand and to operate and move the cutting tool by his other hand when grinding the blade of the cutting tool, thereby greatly causing inconvenience to the user when grinding the blade of the cutting tool, and thereby easily causing danger to the user. In addition, the angle between the blade of the cutting tool and the grindstone is not controlled exactly so that the user cannot adjust the angle between the blade of the cutting tool and the grindstone easily and steadily, thereby causing inconvenience to the user in adjustment of the grinding angle between the blade of the cutting tool and the grindstone, and thereby decreasing the grinding effect of the grindstone. Further, the grindstone provides a one-side grinding function only and cannot provide a double-side grinding function, thereby limiting the versatility and grinding effect of the grindstone.

BRIEF SUMMARY OF THE INVENTION

In accordance with the present invention, there is provided a sharpening tool, comprising a main base having a first end provided with a mounting seat which a first end provided with a first receiving recess and a second end provided with a second receiving recess, two first grinding blades mounted in the first receiving recess of the mounting seat and intersecting each other, an attachment device mounted on a second end of the main base, a grinding unit mounted on the mounting seat of the main base, and a cover mounted on the mounting seat of the main base to cover the grinding unit. The main base is adapted for being affixed to a surface quickly by operation of the attachment device. The two first grinding blades provide a double-side grinding function. The grinding unit is mounted on the second receiving recess of the mounting seat and includes a second grinding blade mounted in the second receiving recess of the mounting seat and having a side provided with a grinding face protruded outward from the second receiving recess of the mounting seat, a limit piece mounted in the second receiving recess of the mounting seat and pressing the second grinding blade to fix the second grinding blade in the second receiving recess of the mounting seat, and a catch plate mounted on the second receiving recess of the mounting seat and having an end provided with an abutting portion facing the grinding face of the second grinding blade. The second grinding blade of the grinding unit provides a one-side grinding function. The cover is locked onto the mounting seat of the main base to clamp the grinding unit and the first grinding blades. The cover has a surface provided with a exposing slot to allow passage of the first grinding blades, and the first grinding blades are protruded and exposed outward from the exposing slot of the cover.

According to the primary advantage of the present invention, the two first grinding blades provide a double-side grinding function to grind the blade of the cutting tool in an upright manner, and the second grinding blade of the grinding unit provides a one-side grinding function to grind the blade of the cutting tool in a transverse manner, thereby enhancing the grinding effect and versatility of the sharpening tool.

According to another advantage of the present invention, the blade of the cutting tool is directly placed between and supported by the intersecting first grinding blades during the grinding process so that the user can grind the blade of the cutting tool by the first grinding blades easily and steadily.

According to a further advantage of the present invention, the grinding face of the second grinding blade and the abutting portion of the catch plate form a grinding space to limit and support the blade of the cutting tool during the grinding process so that the user can grind the blade of the cutting tool by the second grinding blade easily and smoothly.

According to a further advantage of the present invention, the grinding face of the second grinding blade and the abutting portion of the catch plate are arranged at the oblique opening of the mounting seat so that the blade of the cutting tool can be ground efficiently.

According to a further advantage of the present invention, the main base is attached to a smooth surface easily and quickly by operation of the attachment device.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
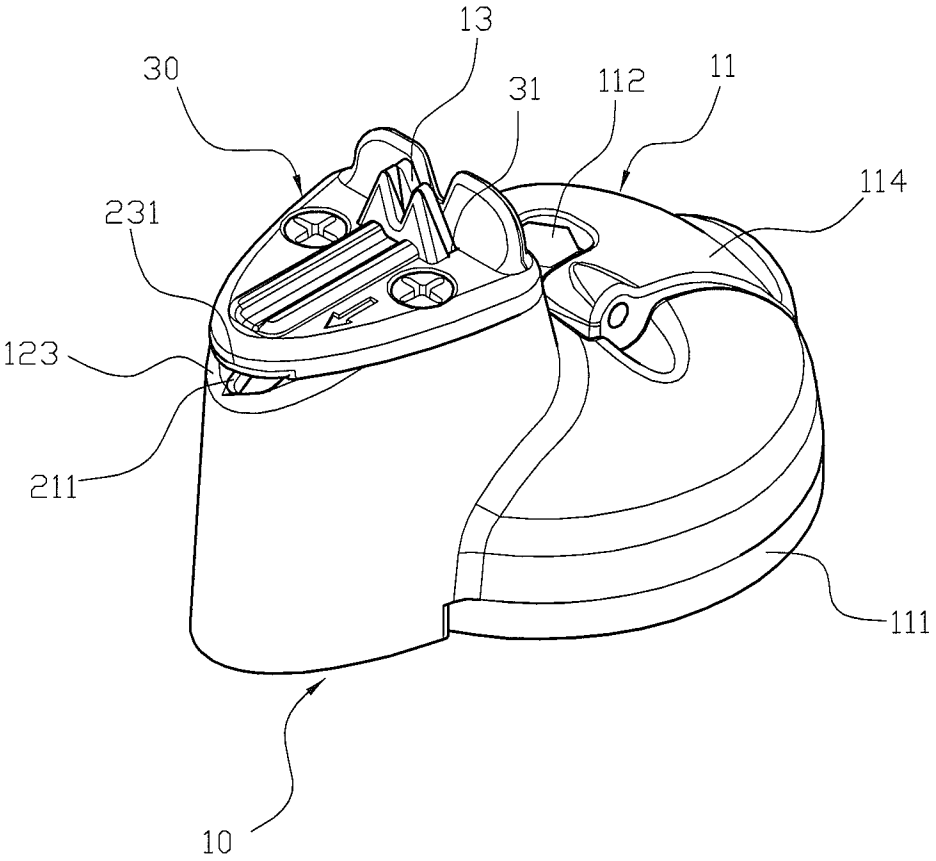
FIG. 1 is a perspective view of a sharpening tool in accordance with the preferred embodiment of the present invention.
Figure 2:
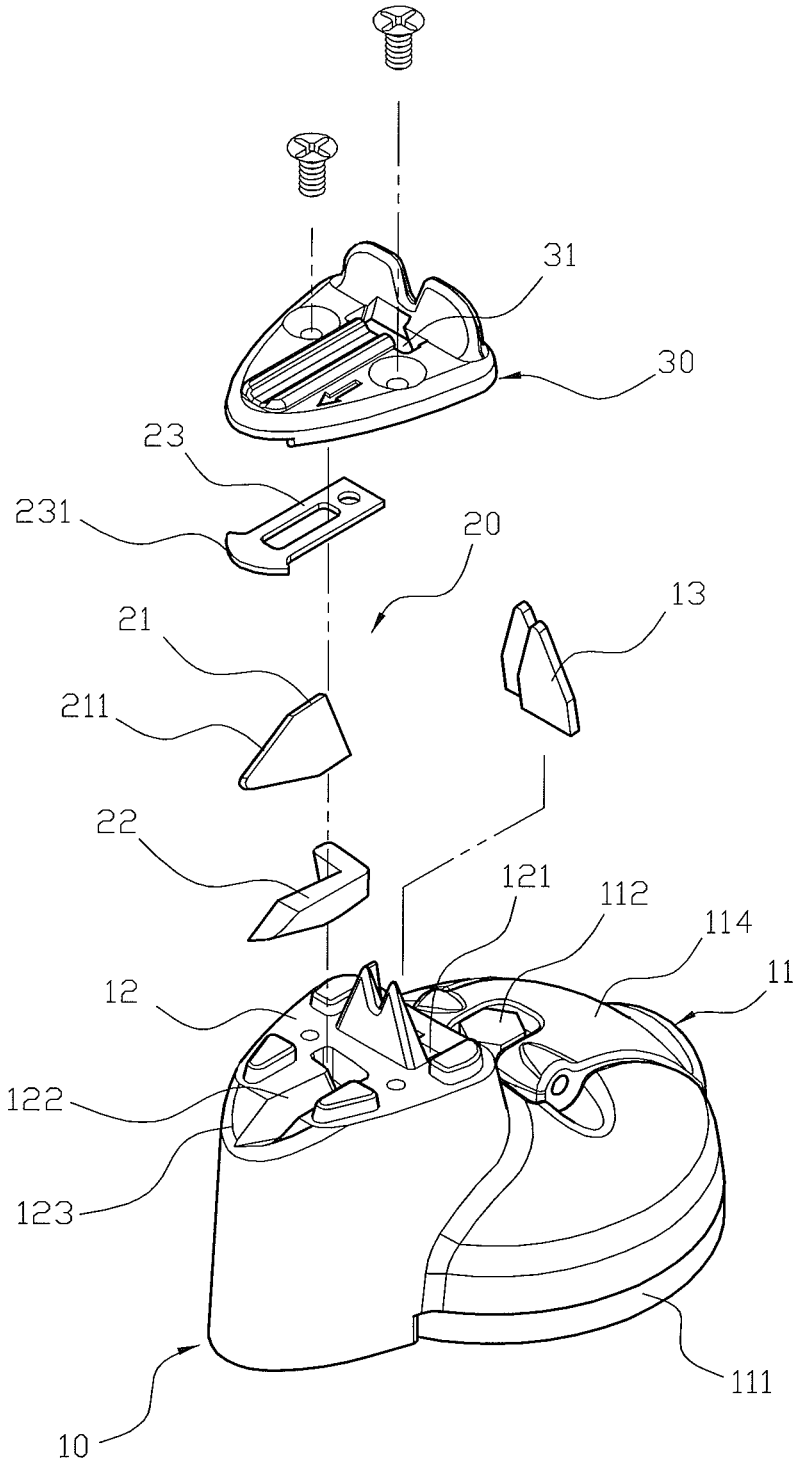
FIG. 2 is an exploded perspective view of the sharpening tool as shown in FIG. 1.
Figure 3:
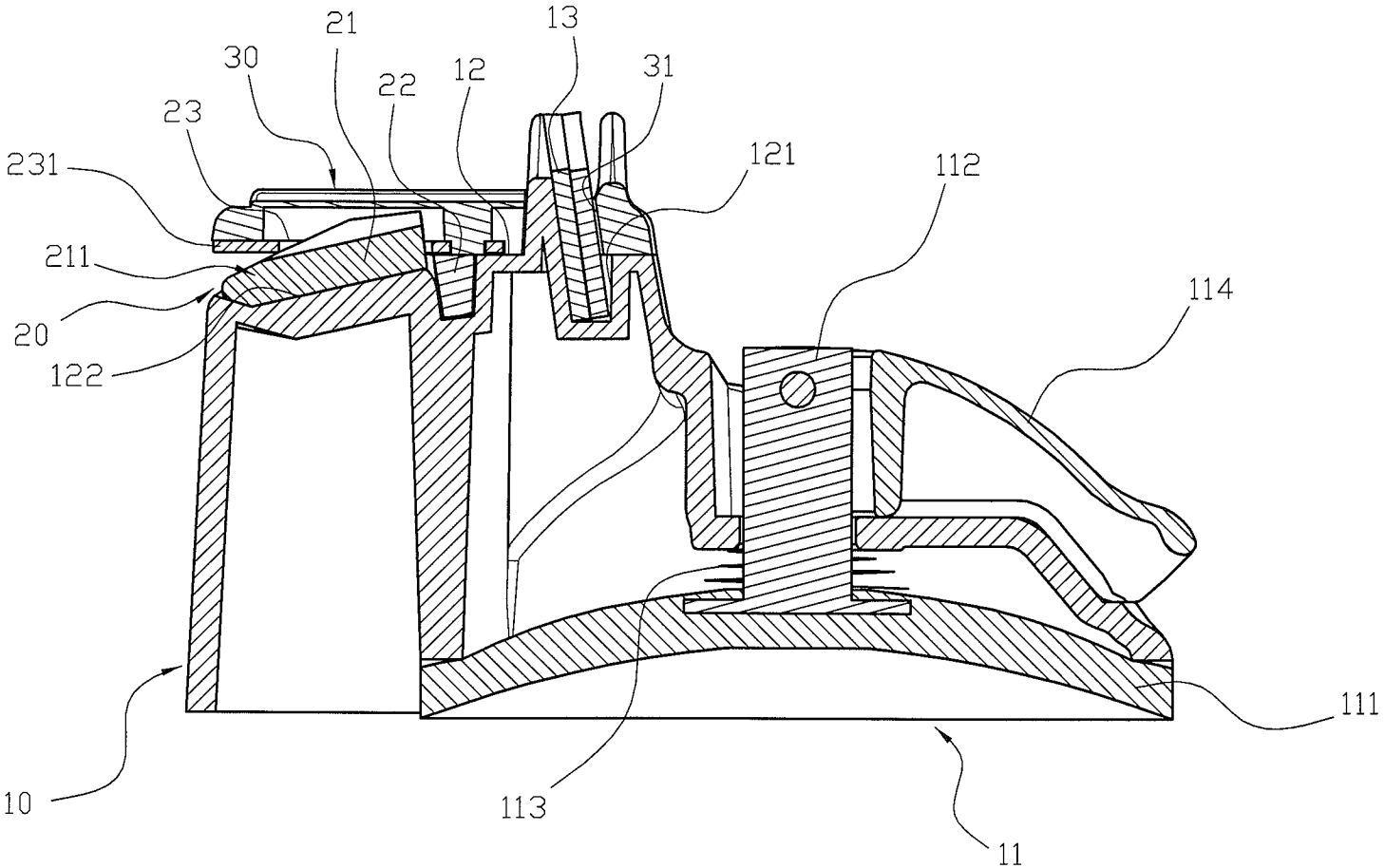
FIG. 3 is a front cross-sectional view of the sharpening tool as shown in FIG. 1.

Referring to the drawings and initially to FIGS. 1-4, a sharpening tool in accordance with the preferred embodiment of the present invention comprises a main base 10 having a first end provided with a mounting seat 12 which a first end provided with a first receiving recess 121 and a second end provided with a second receiving recess 122, two first grinding blades 13 mounted in the first receiving recess 121 of the mounting seat 12 and intersecting each other, an attachment device 11 mounted on a second end of the main base 10, a grinding unit 20 mounted on the mounting seat 12 of the main base 10, and a cover 30 mounted on the mounting seat 12 of the main base 10 to cover the grinding unit 20.

The main base 10 is attached and affixed to a surface (such as a table, wall, cabinet, refrigerator and the like) easily and quickly by operation of the attachment device 11. The two first grinding blades 13 provide a double-side grinding function. The first receiving recess 121 of the mounting seat 12 is disposed between the attachment device 11 and the second receiving recess 122 of the mounting seat 12. The second receiving recess 122 of the mounting seat 12 has a side provided with an oblique opening 123.

Figure 4:
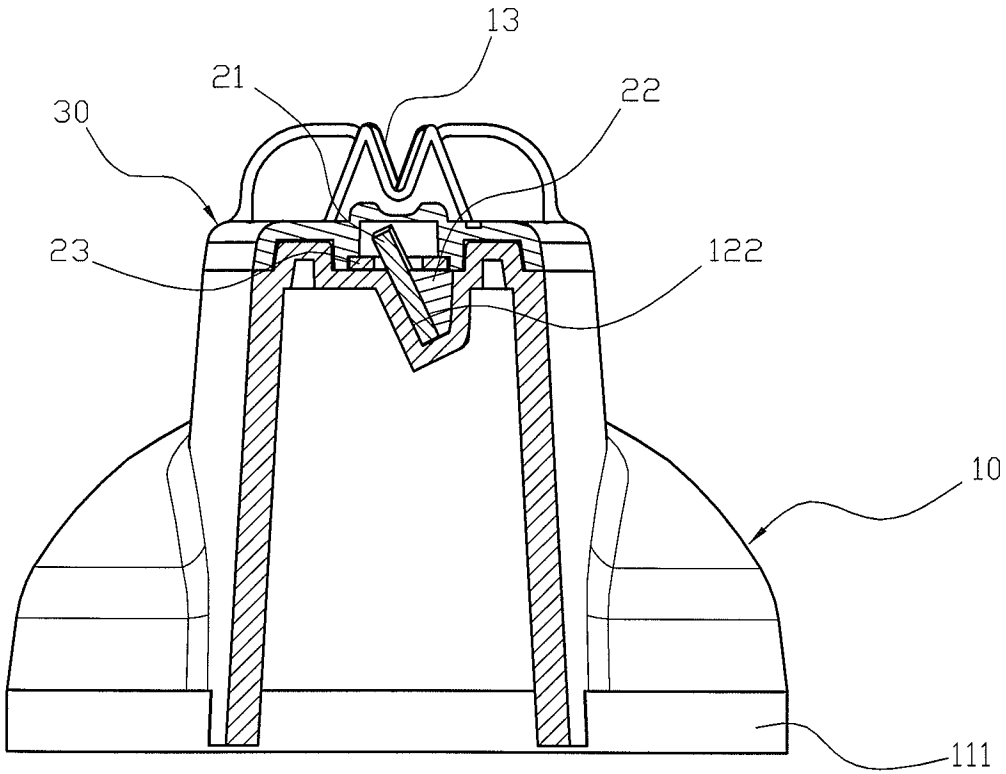
FIG. 4 is a side cross-sectional view of the sharpening tool as shown in FIG. 1.

The grinding unit 20 is mounted on the second receiving recess 122 of the mounting seat 12 and includes a second grinding blade 21 mounted in the second receiving recess 122 of the mounting seat 12 and having a side provided with a grinding face 211 protruded outward from the second receiving recess 122 of the mounting seat 12, a limit piece 22 mounted in the second receiving recess 122 of the mounting seat 12 and pressing the second grinding blade 21 to fix the second grinding blade 21 in the second receiving recess 122 of the mounting seat 12, and a catch plate 23 mounted on the second receiving recess 122 of the mounting seat 12 and having an end provided with an abutting portion 231 facing the grinding face 211 of the second grinding blade 21. The second grinding blade 21 of the grinding unit 20 provides a one-side grinding function. The second grinding blade 21 of the grinding unit 20 is disposed in the second receiving recess 122 of the mounting seat 12 in an inclined manner as shown in FIG. 4. The grinding face 211 of the second grinding blade 21 is exposed outward from the oblique opening 123 of the mounting seat 12. The catch plate 23 of the grinding unit 20 is made of a metallic material. The abutting portion 231 of the catch plate 23 is exposed outward from the oblique opening 123 of the mounting seat 12.

The cover 30 is locked onto the mounting seat 12 of the main base 10 to clamp the grinding unit 20 and the first grinding blades 13. The cover 30 has a surface provided with a exposing slot 31 to allow passage of the first grinding blades 13, and the first grinding blades 13 are protruded and exposed outward from the exposing slot 31 of the cover 30.

In assembly, the first grinding blades 13 are mounted in the first receiving recess 121 of the mounting seat 12 and are arranged in an intersecting manner. Then, the second grinding blade 21 of the grinding unit 20 is placed into and disposed in the second receiving recess 122 of the mounting seat 12 in an inclined manner with the grinding face 211 of the second grinding blade 21 being exposed outward from the oblique opening 123 of the mounting seat 12. Then, the limit piece 22 is placed into the second receiving recess 122 of the mounting seat 12 and presses the second grinding blade 21 to fix the second grinding blade 21 in the second receiving recess 122 of the mounting seat 12. Then, the catch plate 23 is mounted on the second receiving recess 122 of the mounting seat 12 to cover the second grinding blade 21 and the limit piece 22, with the abutting portion 231 of the catch plate 23 facing the grinding face 211 of the second grinding blade 21. At this time, the grinding face 211 of the second grinding blade 21 and the abutting portion 231 of the catch plate 23 form a grinding space. Finally, the cover 30 is locked onto the mounting seat 12 of the main base 10 to clamp the grinding unit 20 and the first grinding blades 13, with the first grinding blades 13 being protruded and exposed outward from the exposing slot 31 of the cover 30.

The attachment device 11 includes a pull lever 112 movably extended through the main base 10 and having a first end protruded outward from a first side of the main base 10 and a second end protruded outward from a second side of the main base 10, a sucker 111 mounted on the first side of the main base 10 and connected with the first end of the pull lever 112, a control handle 114 mounted on the second side of the main base 10 and pivotally connected with the second end of the pull lever 112, and an elastic member 113 mounted on the pull lever 112 and biased between the main base 10 and the sucker 111. The sucker 111 of the attachment device 11 can produce a vacuum suction force so that the sucker 111 is boned onto to a surface to attach and affix the main base 10 to the surface.

In assembly of the attachment device 11, when the control handle 114 is pivoted on the main base 10 to pull the pull lever 112, the pull lever 112 is lifted, and the sucker 111 is pulled toward the main base 10 by pulling of the pull lever 112 so that the sucker 111 is compressed and contracted inward to form a vacuum space between the sucker 111 and the surface so as to bond the sucker 111 onto the surface closely and exactly and to attach the main base 10 to the surface.

Figure 5:
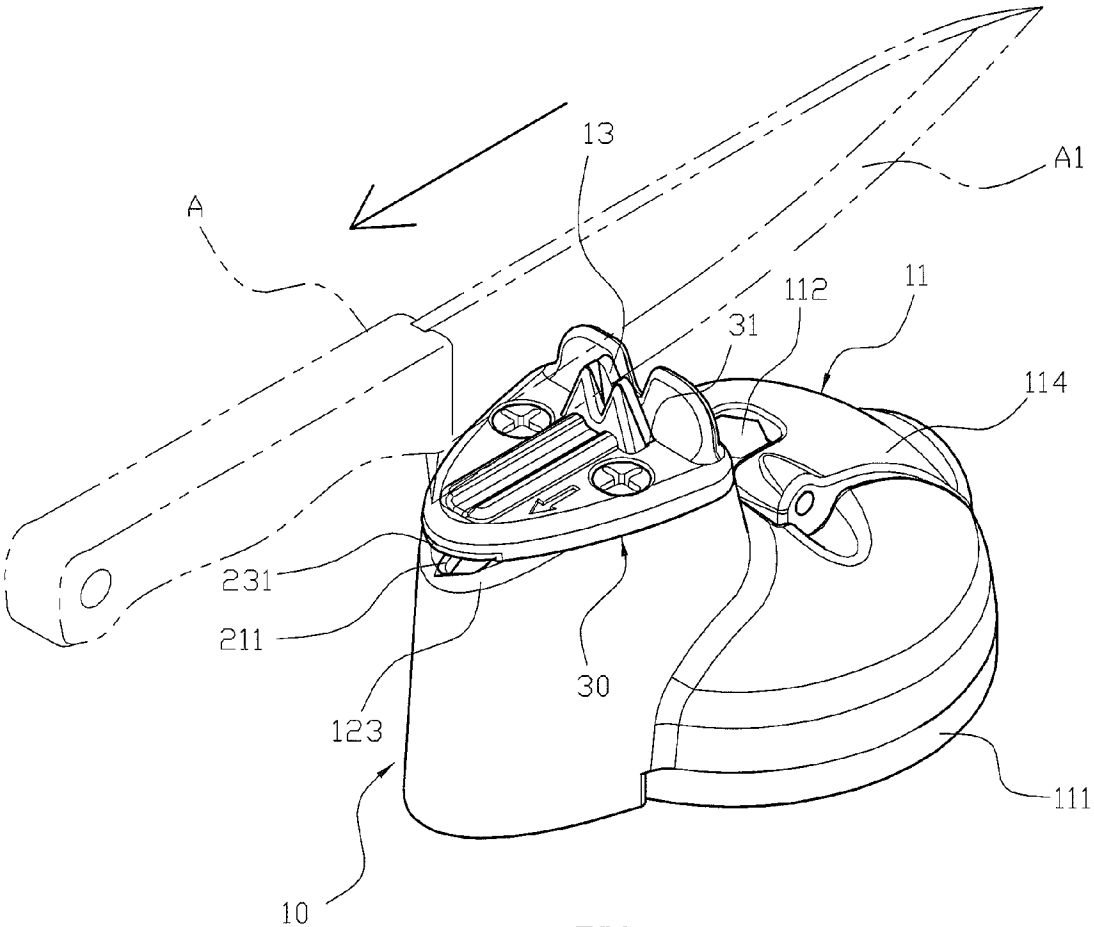
FIG. 5 is a schematic operational view of the sharpening tool as shown in FIG. 1.

In operation, referring to FIG. 5 with reference to FIGS. 1-4, the sharpening tool is used to grind and sharpen a first cutting tool "A" (such as a knife or the like). At this time, the blade "A1" of the first cutting tool "A" is disposed at a vertical state and is placed between the intersecting first grinding blades 13 so that when the first cutting tool "A" is moved forward and backward relative to the main base 10 in a reciprocal manner, the first grinding blades 13 grind two opposite sides of the blade "A1" of the first cutting tool "A" so as to sharpen the blade "A1" of the first cutting tool "A" in a double-side grinding manner. In such a manner, the first grinding blades 13 can grind the two opposite sides of the blade "A1" of the first cutting tool "A" so that a user does not need to adjust the grinding angle between the blade "A1" of the first cutting tool "A" and the first grinding blades 13.

Figure 6:
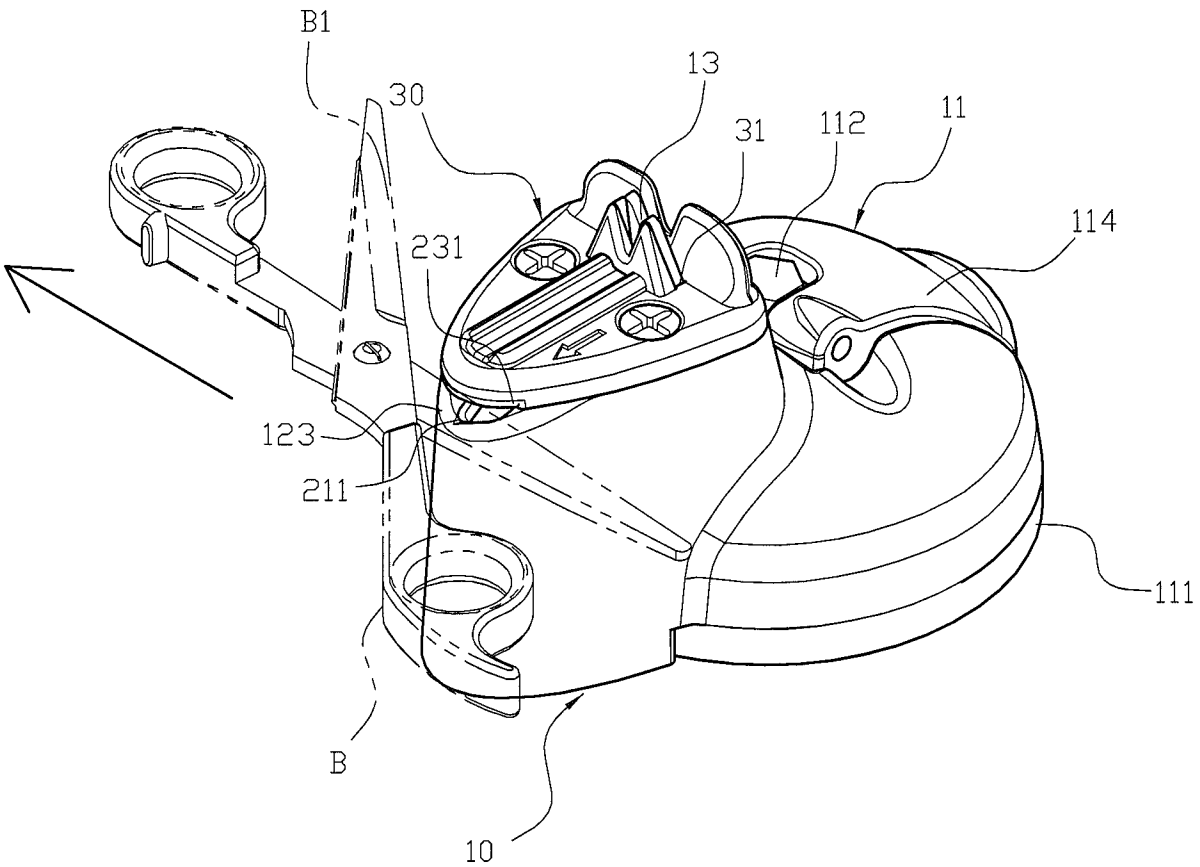
FIG. 6 is another schematic operational view of the sharpening tool as shown in FIG. 1.

Alternatively, referring to FIG. 6 with reference to FIGS. 1-4, the sharpening tool is used to grind and sharpen a second cutting tool "B" (such as a pair of scissors, shears or the like). At this time, the blade "B1" of the second cutting tool "B" is disposed at a horizontal state and is placed in the grinding space formed by the grinding face 211 of the second grinding blade 21 and the abutting portion 231 of the catch plate 23 so that when the second cutting tool "B" is moved forward and backward relative to the main base 10 in a reciprocal manner, the second grinding blade 21 grinds one side of the blade "B1" of the second cutting tool "B" so as to sharpen the blade "B1" of the second cutting tool "B" in a one-side grinding manner. In such a manner, the blade "B1" of the second cutting tool "B" abuts and is supported by the abutting portion 231 of the catch plate 23 during the grinding action of the second grinding blade 21 so that the blade "B1" of the second cutting tool "B" is ground by the second grinding blade 21 easily and smoothly. In addition, the catch plate 23 of the grinding unit 20 is made of a metallic material and abuts the blade "B1" of the second cutting tool "B" to prevent the blade "B1" of the second cutting tool "B" from directly touching the cover 30 and to prevent wear of the cover 30.

Accordingly, the two first grinding blades 13 provide a double-side grinding function to grind the blade of the cutting tool in an upright manner, and the second grinding blade 21 of the grinding unit 20 provides a one-side grinding function to grind the blade of the cutting tool in a transverse manner, thereby enhancing the grinding effect and versatility of the sharpening tool. In addition, the blade of the cutting tool is directly placed between and supported by the intersecting first grinding blades 13 during the grinding process so that the user can grind the blade of the cutting tool by the first grinding blades 13 easily and steadily. Further, the grinding face 211 of the second grinding blade 21 and the abutting portion 231 of the catch plate 23 form a grinding space to limit and support the blade of the cutting tool during the grinding process so that the user can grind the blade of the cutting tool by the second grinding blade 21 easily and smoothly. Further, the grinding face 211 of the second grinding blade 21 and the abutting portion 231 of the catch plate 23 are arranged at the oblique opening 123 of the mounting seat 12 so that the blade of the cutting tool can be ground efficiently. Further, the main base 10 is attached to a smooth surface easily and quickly by operation of the attachment device 11.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A sharpening tool, comprising:

a main base, one end of which having an attachment device and the other end of which having a mounting seat, the mounting seat having a first receiving recess and a second receiving recess, and two first grinding blades intersecting each other disposed in the first receiving recess of the mounting seat;

a grinding unit disposed in the second receiving recess, including a second grinding blade, a limit piece and a catch plate, wherein the second grinding blade is restricted and secured at the second receiving recess by the limit piece, the grinding surface of the second grinding blade protrudes out from the second receiving recess, and the catch plate, which has an abutting portion extending toward the grinding surface, covers the second receiving recess, and a cover mounted on the mounting seat of the main base to secure the grinding unit and the first grinding blades, the first grinding blades protruding out from an exposing slot of the cover, wherein the grinding surface of the second grinding blade and the abutting portion of the catch plate are arranged at an oblique opening of the mounting seat to increase efficiency of the sharpening tool.

2. The sharpening tool of claim 1, wherein the attachment device includes a sucker, a pull lever, an elastic member and a control handle, the pull lever passing through the main base to connect with the sucker on one end and the pull lever on the other end, the elastic member biased between the sucker and main base, so when the pull lever is driven by the control handle, the sucker is configured to contract toward the main base to secure the sharpening tool to a surface.

3. The sharpening tool of claim 1, wherein the catch plate of the grinding unit is made by metallic material and is adapted for abutting a blade of a cutting tool to prevent the blade of the cutting tool from directly touching the cover and to prevent wear of the cover.

4. The sharpening tool of claim 1, wherein the grinding face of the second grinding blade is exposed outward from the oblique opening of the mounting seat; and the abutting portion of the catch plate is exposed outward from the oblique opening of the mounting seat.

5. The sharpening tool of claim 1, wherein the second grinding blade of the grinding unit is disposed in the second receiving recess of the mounting seat in an inclined manner.

* * * * *